US012703534B2

(12) United States Patent
De Smet et al.

(10) Patent No.: US 12,703,534 B2
(45) Date of Patent: Aug. 11, 2026

(54) BEVERAGE CAN

(71) Applicants: Anheuser-Busch InBev S.A., Brussels (BE); Envases Universales de México SAPI de CV, Mexico City (MX)

(72) Inventors: Jan De Smet, Leuven (BE); David Lieb, Beulah, CO (US); Bradley Kenneth Deuser, Saint Clair, MO (US); Evan O'Connor, Leuven (BE); Frederik Fernand S. De Graaf, Leuven (BE)

(73) Assignees: ANHEUSER-BUSCH INBEV S.A., Brussels (BE); ENVASES UNIVERSALES DE MÉXICO SAPI DE CV, Mexico City (MX)

( * ) Notice: Subject to any disclaimer, the term of this patent is extended or adjusted under 35 U.S.C. 154(b) by 0 days.

(21) Appl. No.: 18/725,068

(22) PCT Filed: Dec. 8, 2022

(86) PCT No.: PCT/EP2022/084917
§ 371 (c)(1),
(2) Date: Jun. 27, 2024

(87) PCT Pub. No.: WO2023/126141
PCT Pub. Date: Jul. 6, 2023

(65) Prior Publication Data

US 2025/0100740 A1 Mar. 27, 2025

(30) Foreign Application Priority Data

Dec. 27, 2021 (BE) ..... 2021/6068

(51) Int. Cl.
*B65D 1/16* (2006.01)
*B21D 51/26* (2006.01)

(52) U.S. Cl.
CPC ..... *B65D 1/165* (2013.01); *B21D 51/26* (2013.01)

(58) Field of Classification Search
CPC ..... B65D 1/165; B65D 1/16; B21D 51/26
(Continued)

(56) References Cited

U.S. PATENT DOCUMENTS

D43,323 S 12/1912 Sauer
D231,773 S 6/1974 Mascia
(Continued)

FOREIGN PATENT DOCUMENTS

CA 148988 S 10/2013
CL 199300159 2/1994
(Continued)

OTHER PUBLICATIONS

"Minimalist Soda Can—a photo on Flickriver", Available on internet at: www.pinterest.cl, webpage found Mar. 10, 2023, 1 page.
(Continued)

*Primary Examiner* — Steven A. Reynolds
(74) *Attorney, Agent, or Firm* — ArentFox Schiff LLP

(57) ABSTRACT

A beverage can comprising a body having a body diameter Db of between 58 mm and 60 mm, and a base comprising a stand having a stand diameter Ds of between 44 mm and 48 mm; and a method of manufacturing the same comprising forming the body and forming the base.

12 Claims, 2 Drawing Sheets

(58) Field of Classification Search
USPC ..... 220/606, 604, 608, 669, 906
See application file for complete search history.

(56) References Cited

U.S. PATENT DOCUMENTS

| | | | | |
|---|---|---|---|---|
| D241,017 | S | 8/1976 | Baker | |
| D262,517 | S | 1/1982 | Hayes | |
| D263,024 | S | 2/1982 | Atkinson | |
| D267,393 | S | 12/1982 | Gruodis et al. | |
| D271,854 | S | 12/1983 | Berry | |
| D272,508 | S | 2/1984 | Conti | |
| 4,620,434 | A | 11/1986 | Pulciani et al. | |
| 4,834,256 | A * | 5/1989 | McMillin | B65D 21/0217 220/606 |
| 4,919,294 | A * | 4/1990 | Kawamoto | B65D 1/165 220/606 |
| D320,153 | S | 9/1991 | Cassai et al. | |
| 5,105,973 | A * | 4/1992 | Jentzsch | B65D 1/165 220/606 |
| D356,501 | S | 3/1995 | Kornick et al. | |
| D371,075 | S | 6/1996 | Stonehouse | |
| 5,605,248 | A * | 2/1997 | Jentzsch | B65D 1/26 215/373 |
| 5,645,190 | A * | 7/1997 | Goldberg | B65D 1/165 220/674 |
| D389,734 | S | 1/1998 | Schultz et al. | |
| 5,836,473 | A * | 11/1998 | Jentzsch | B21D 51/26 220/604 |
| D403,962 | S | 1/1999 | Ramsey | |
| D403,964 | S | 1/1999 | Jansen | |
| 6,098,832 | A * | 8/2000 | Jentzsch | B65D 1/0276 220/604 |
| D432,015 | S | 10/2000 | Holiday | |
| 6,131,761 | A * | 10/2000 | Cheng | B65D 1/165 220/608 |
| D434,323 | S | 11/2000 | Pattison | |
| 6,241,114 | B1 | 6/2001 | Savino et al. | |
| 6,296,139 | B1 * | 10/2001 | Hanafusa | B65D 1/165 220/608 |
| 6,959,830 | B1 | 11/2005 | Kanou et al. | |
| D549,420 | S | 8/2007 | Naber | |
| D554,000 | S | 10/2007 | Walsh | |
| D570,228 | S | 6/2008 | Van Dam | |
| 7,395,686 | B2 * | 7/2008 | Dervy | B21D 22/30 72/379.4 |
| 7,398,894 | B2 * | 7/2008 | Rajagopalan | B65D 17/02 220/608 |
| 7,472,800 | B2 | 1/2009 | Dervy et al. | |
| D603,722 | S | 11/2009 | Reimer | |
| D605,060 | S | 12/2009 | Reimer | |
| D607,754 | S | 1/2010 | Hayden et al. | |
| D618,115 | S | 6/2010 | Huls et al. | |
| D623,963 | S | 9/2010 | Fairchild, Jr. et al. | |
| D632,588 | S | 2/2011 | George | |
| D640,141 | S | 6/2011 | Chapin | |
| D641,644 | S | 7/2011 | George | |
| 8,313,004 | B2 * | 11/2012 | Stodd | B65D 7/12 220/619 |
| D671,843 | S | 12/2012 | Plosky et al. | |
| 8,371,471 | B2 * | 2/2013 | Khowaylo | B65D 81/3841 220/592.27 |
| D678,784 | S | 3/2013 | Aranha | |
| D693,120 | S | 11/2013 | Roth et al. | |
| D706,032 | S | 6/2014 | Roth et al. | |
| D715,162 | S | 10/2014 | Farrow et al. | |
| D745,417 | S | 12/2015 | Zebert et al. | |
| D779,974 | S | 2/2017 | Florkiewicz et al. | |
| 2005/0109787 | A1 * | 5/2005 | Rajagopalan | B65D 17/02 220/608 |
| 2005/0194388 | A1 * | 9/2005 | Dervy | B21D 51/26 220/608 |
| 2009/0272750 | A1 * | 11/2009 | Rajagopalan | B65D 1/0276 220/600 |
| 2016/0318645 | A1 | 11/2016 | Wersuhn | |
| 2020/0047944 | A1 * | 2/2020 | Hundeloh | B65D 17/4012 |
| 2020/0140140 | A1 * | 5/2020 | Hundeloh | B65D 17/4012 |
| 2022/0242605 | A1 * | 8/2022 | Arbab | B65D 1/165 |
| 2023/0002101 | A1 * | 1/2023 | Fukumoto | B21D 51/26 |
| 2024/0300687 | A1 * | 9/2024 | Kobayashi | B65D 1/165 |

FOREIGN PATENT DOCUMENTS

| | | | |
|---|---|---|---|
| CL | 199400642 | | 7/1995 |
| CL | 199700294 | | 11/1997 |
| CL | 199901581 | | 12/1999 |
| CL | 200100819 | | 4/2002 |
| CN | 302840354 | | 6/2014 |
| CN | 303132417 | | 3/2015 |
| CN | 204776466 | U | 11/2015 |
| CN | 105899433 | A | 8/2016 |
| CN | 304374070 | | 11/2017 |
| CN | 305954773 | | 7/2020 |
| CN | 306180570 | | 11/2020 |
| CN | 306860955 | | 10/2021 |
| DE | 0076463 | | 6/2011 |
| DE | 0082184 | | 9/2013 |
| DE | 102015215590 | A1 | 2/2017 |
| EM | 000005392-0002 | | 4/2003 |
| EM | 000096334-0001 | | 2/2004 |
| EM | 000103262-0001 | | 2/2004 |
| EM | 000122494-0001 | | 4/2004 |
| EM | 000437595-0001 | | 1/2006 |
| EM | 000439369-0001 | | 1/2006 |
| EM | 000469242-0001 | | 3/2006 |
| EM | 000966387-0001 | | 7/2008 |
| EM | 001901588-0002 | | 9/2011 |
| EM | 001931155-0004 | | 10/2011 |
| EM | 001958539-0001 | | 2/2012 |
| EM | 001965005-0027 | | 7/2012 |
| EM | 002186544-0001 | | 5/2013 |
| EM | 002099044-0001 | | 7/2013 |
| EM | 002928028-0001 | | 1/2016 |
| EM | 005813862-0002 | | 11/2018 |
| FR | 0034610 | | 11/2003 |
| FR | 0073062 | | 2/2010 |
| FR | 0092667 | | 5/2016 |
| GB | 2315478 | A | 2/1998 |
| JP | 2016-043991 | A | 4/2016 |
| JP | 0091666 | | 6/2016 |
| TW | 287921 | S | 10/1996 |
| TW | D108426 | S | 12/2005 |
| TW | D118909 | S | 9/2007 |
| VN | 3-0017228-000 | | 10/2012 |
| VN | 3-0026166-000 | | 4/2018 |
| VN | 3-0031474-000 | | 9/2020 |
| VN | 3-0031475-000 | | 9/2020 |
| VN | 3-0032772-000 | | 5/2021 |
| VN | 3-2021-01756 | | 7/2021 |
| VN | 3-0036966-000 | | 7/2023 |
| WO | DM/034610 | | 11/2003 |
| WO | DM/073062 | | 2/2010 |
| WO | DM/076463 | | 6/2011 |
| WO | DM/082184 | | 9/2013 |
| WO | 2014/055399 | A1 | 4/2014 |
| WO | DM/092667 | | 5/2016 |
| WO | DM/091666 | | 6/2016 |
| WO | 2017/008961 | A1 | 1/2017 |

OTHER PUBLICATIONS

Cambodian Department of Intellectual Property, application No. KH/D/2018/00150, on Nov. 28, 2018.

Canadian Office Action received for Canadian Patent Application No. 213688, mailed on Aug. 15, 2024, 4 pages.

Chilean Patent Office Expert's Report for Application No. 202201725 dated Mar. 13, 2023 (43 pages).

Chinese National Intellectual Property Administration, application No. 201330372467.5, on Aug. 5, 2013.

European Union Intellectual Property Office, application No. 7884689, on May 12, 2020.

(56) References Cited

OTHER PUBLICATIONS

Image of Drink Can, publicly available via Facebook, published Jul. 9, 2020 by Anheuser-Busch (2 pages, including a statement of relevance).
International Search Report and Written Opinion received for PCT Patent Application No. PCT/EP2022/084917, mailed on Mar. 6, 2023, 11 pages.
Non-Final Office Action received for U.S. Appl. No. 29/843,623, mailed on Dec. 19, 2023, 8 pages.
Office Action received for Canadian Patent Application No. 213688, mailed on Jan. 8, 2024, 2 pages.
United States Patent and Trademark Office, U.S. Appl. No. 29/712,883, on Nov. 12, 2019.
Office Action received for Chinese Patent Application No. 202230385260.0, mailed on Dec. 25, 2023, 1 pages.
Office Action received for Chinese Patent Application No. 202230385260.0, mailed on Jul. 5, 2023, 1 pages.
Office Action received for Chinese Patent Application No. 202230385260.0, mailed on May 16, 2024, 1 pages.
Office Action received for Colombian Patent Application No. NC2022/0008653, mailed on Jan. 4, 2024, 14 pages.
Office Action received for Colombian Patent Application No. NC2022/0008653, mailed on Jul. 18, 2023, 8 pages.
Office Action received for Colombian Patent Application No. NC2022/0008655, mailed on Jan. 4, 2024, 14 pages.
Office Action received for Colombian Patent Application No. NC2022/0008655, mailed on Jul. 18, 2023, 8 pages.
Office Action received for Colombian Patent Application No. NC2022/0008654, mailed on Jan. 4, 2024, 14 pages.
Office Action received for Colombian Patent Application No. NC2022/0008654, mailed on Jul. 18, 2023, 8 pages.
Office Action received for Indian Patent Application No. 366596-001, mailed on Sep. 19, 2022, 2 pages.
Office Action received for Korean Patent Application No. 30-2022-0024895, mailed on Aug. 4, 2022, 4 pages.
Office Action received for Mexican Patent Application No. MX/f/2022/001764, mailed on Apr. 29, 2024, 12 pages.
Office Action received for Mexican Patent Application No. MX/f/2022/001764, mailed on Jul. 15, 2022, 8 pages.
Office Action received for Turkey Patent Application No. 2022/007843, mailed on May 30, 2023, 3 pages.
Office Action received for Turkey Patent Application No. 2022/007843, mailed on Sep. 29, 2022, 4 pages.
Search Report received for Belgium Patent Application No. 20216068, mailed on May 30, 2022, 11 pages.
VI Packing, <www.vipackaging.com.au>, LATA 330 ML Natural Cla'sica Cerveza, webpage publicly available on or before Dec. 22, 2014.
Taiwan Patent Office Action for Application No. 111303042 dated Dec. 30, 2022 (6 pages, English translation included).
United Kingdom's Intellectual Property Office, application No. 90078846890001, on May 12, 2020.
United Kingdom's Intellectual Property Office, application No. 90078846890003, on May 12, 2020.
Examination Subsequent Report received in CA Application No. 213688, mailed Aug. 15, 2024.
Office Action received for Vietnamese Patent Application No. 3-2022-01247, mailed on Apr. 25, 2025, 38 pages (19 pages of English Translation and 19 pages of Original Document).
Office Action received for Chinese Patent Application No. 202280085769.0, mailed on Mar. 27, 2026, 19 pages (6 pages of English Translation and 13 pages of Original Document).

* cited by examiner

BEVERAGE CAN

CROSS-REFERENCE TO RELATED APPLICATIONS

The present application is a national stage application filed under 35 U.S.C. 371 based on International Patent Application No. PCT/EP2022/084917, filed on Dec. 8, 2022, which claims priority to BE Patent Application No. BE2021/6068, filed on Dec. 27, 2021, which are incorporated herein by reference in their entireties.

FIELD

This relates to beverage cans and methods of manufacturing beverage cans. In particular, beverage cans for a carbonated beverage.

BACKGROUND

Current beverage cans in industry are harmonized in diameter towards two standards: Standard ("211 standard") having a 66 mm body diameter and Sleek ("204 standard") having a 55 mm body diameter. Cans are sealed, after filling, with an end plate. In the past 209, 206, and 204 end plates have been used, but the industry has harmonized toward 202 and 200 standard end plates having a plate diameter of 52 mm and 50 mm respectively.

The beverage can production process commonly comprises three mechanical steps to form the cans from flat discs of metal. The first step is "cupping". The discs are cut out from sheet metal and formed into a "cup". The dimensions of the cup define the amount of metal comprised in each can. The next step is the forming of the can body. The wall of the "cup" is elongated and the wall thicknesses are defined. The wall forming the body of the can is defined by a midwall section, a topwall section and a transition section therebetween. A base of the can is also shaped during this process step. Following the base and body forming is "necking". The topwall section of the wall is deformed into a neck (e.g. a narrowing of the wall diameter), and a flange at the end of the neck. Necking causes the wall thickness of the neck to increase as the diameter is reduced. The base of the can is slightly deformed at the end to strengthen the can and provide additional pressure resistance. This deformation process is known in the industry as "reforming". The can is then ready to be filled with a beverage, and seamed, e.g. the end plate is sealed against the flange by folding the edge of the end plate and the flange together in a seaming operation.

Previous efforts have been made to reduce the weight of cans. These include gauge reduction, i.e. reducing the thickness of the sheet metal from which the can manufacture process begins. This requires optimisation of the base design to compensate for loss in pressure resistance from the resulting reduced wall thicknesses. Previous efforts have also been made by adapting the wall thickness (midwall and topwall) of the body. Previous efforts in lightweighting also include reform optimization to strengthen any new base design. In general, these design strategies retain the same standard body diameter.

An object of the present invention is to reduce the amount of metal required in a beverage can, compared with at least some known beverage cans.

SUMMARY

In a first aspect there is provided a beverage can comprising a body having a body diameter Db of between 58 mm and 60 mm, and a base comprising a stand having a stand diameter Ds of between 44 mm and 48 mm.

Beneficially, using a non-standard body diameter allows the stand diameter to be selected such that the weight of the base is reduced (compared with a conventional beverage can), whilst maintaining sufficient strength of the base. In turn, this allows for reduced wall thickness, which also reduces the weight of the beverage can. The beverage can may also be compatible with 200 standard end plates (i.e. end plates having a diameter of 50 mm with a tolerance of 0.25 mm). Compliance with the 200 standard end plates may provide benefits. For example, the drink opening is not changed compared with conventional beverage cans and thus the user experience when drinking or pouring the beverage from the beverage can is unchanged. Advantageously, a non-standard body diameter combined with a 200 standard end plate can provide beverage cans which are lighter than prior art beverage cans, but which can be handled by conventional machinery designed to handle beverage cans with 200 standard end plates. Compliance with the 200 standard may for example provide compatibility with industry standard machinery such as filling and seaming machinery. The beverage can may be suitable for high speed, high volume manufacturing. The beverage can may capable of withstanding e.g. 6.2 bar pressure, and e.g. a 550 N top load.

The body diameter Db may be between 58.5 mm and 59.5 mm, e.g. between 58.8 mm and 59.2 mm. The body diameter Db may be 59 mm. Beneficially, the body diameter Db may be selected to optimise the wall thickness of the body, and the weight of the base.

A stand diameter outside of the range of the first aspect may prevent the beverage can from having sufficient internal pressure resistance. The stand diameter Ds may be between 45.2 mm and 46.2 mm in order to provide good internal pressure resistance performance of the beverage can. The stand diameter Ds may be between 45.5 mm and 45.9 mm. The stand diameter Ds may be 45.72 mm.

Minimising the stand diameter may increase the pressure resistance of the can. The stand diameter may be optimised to increase pressure resistance whilst mitigating the risk of squatting of a portion of the base radially outward of the stand, herein referred to as a chime region of the base. Beneficially the stand diameter may provide sufficient pressure resistance to a carbonated beverage within the can, e.g. 6.2 bar pressure resistance, and sufficient top load resistance, e.g. 550N top load resistance. A stand diameter less than 50 mm may permit the can to be stackable with any other can having a 200 standard end plate.

The ratio of the body diameter Db to the stand diameter Ds may be 1.3. This ratio may optimise weight and strength of the body and the base. Larger ratios may require the thickness and therefore weight of the base to be increased, in order to provide the base with strength to reduce a risk of squatting of the chime region when pressure is applied to the can.

The body may comprise a midwall. The midwall may have a wall thickness Tm of between 0.08 mm and 0.09 mm, e.g. between 0.079 mm and 0.089 mm. The midwall may have an average wall thickness Tm of approximately 0.084 mm. The thickness of the midwall may be generally uniform. The thickness of the midwall may have a maximum variation of ±0.005 mm across the midwall. Beneficially, the midwall thickness may provide the can with sufficient top load resistance, e.g. 550 N of top load resistance.

The base may have a thickness between 0.21 mm and 0.24 mm. The base may have a thickness of between 0.210 mm and 0.238 mm, e.g. between 0.224 mm and 0.234 mm. The base may have a thickness of approximately 0.23 mm, e.g. 0.228 mm or 0.229 mm.

The base may further comprise a dome. The dome may be inside, e.g. radially inward of, the stand. The base may have a dome height Hdr of between 8.9 mm and 9.9 mm. The base may have a dome height Hdr of less than 9.7 mm, e.g. less than 9.65 mm. The base may have a dome height Hdr of between 9.1 mm and 9.7 mm. The base may have a dome height Hdr of 9.4 mm. The dome height may be optimised to maximise the strength of the base and minimise the weight of the base.

The base may comprise a reformed portion between the stand and the dome. The reformed portion of the base may have a reform height Hr of 2.42 mm or less. The reformed portion of the base may have a reform height Hr of between 2.1 mm and 2.3 mm, e.g. between 2.16 mm and 2.26 mm. The reformed portion of the base may have a reform height Hr of 2.21 mm. The reformed portion of the base may have a reform diameter Dr between 45 mm and 46 mm, e.g. between 45.3 mm and 45.4 mm. The reformed portion of the base may have a reform diameter Dr of 45.33 mm.

The beverage can may further comprise a neck. The neck may have an end diameter De between 49 mm and 51 mm. The neck may have an end diameter De between 49.5 mm and 50.6 mm. The neck may have an end diameter between 49.7 mm and 50.3 mm. The neck may have an end diameter De between 49.78 mm and 50.24 mm. Beneficially, the neck may comply with the 200 standard so that the can may be compatible with industry standard machinery, for example filling and seaming machinery. The neck may have an end diameter De of 50 mm or 50.01 mm. The preferred end diameter De, in combination with the preferred stand diameter Ds and preferred body diameter Db, may permit the wall thicknesses of the beverage can to be reduced as compared to known beverage cans. Since the wall thickness of the neck increases during the necking process as the diameter is reduced, selecting the body diameter Db relative to the end diameter De allows the desired flange thickness to be obtained.

The ratio of the body diameter Db to the end diameter De may be 1.2. This may maximise the body diameter whilst ensuring the end remains compatible with the 200 standard and the beverage can has sufficient strength. Optimising the ratio of the body diameter Db to the end diameter De with the ratio of the body diameter Db to the stand diameter Ds may optimise reducing the wall thicknesses of the beverage can compared to known beverage cans whilst ensuring that a desired flange thickness can be achieved.

The neck may have a neck angle N, e.g. the angle between the neck and the body, of approximately 30°. Beneficially this may optimise the top load resistance of the can and the amount of metal required to form the neck.

The neck may have a neck height Hn of 14.45 mm.

The beverage can may further comprise a flange. The neck may be between the body and the flange. The flange may be generally annular. The flange may circumscribe the neck. The flange thickness Tf may be between 0.145 mm and 0.160 mm. The flange width may be between 1.93 mm and 2.33 mm. The flange width may be 2.08 mm. Beneficially the dimensions of the flange may allow for effective seaming. The flange thickness may comply with the industry standard (which is 0.145 mm to 0.160 mm). Beneficially, the flange may be compatible with existing machinery, e.g. seaming tools which use the 200 standard.

The beverage can may have a volume of 330 ml, 355 ml, 410 ml, a different volume.

The height of the beverage can may depend on the volume of the beverage can. The height of the beverage can may be 175 mm or less to ensure stability of the beverage can. The height of the beverage can may be between 100 mm and 175 mm, e.g. between 110 mm and 170 mm. The height of the beverage can may be optimised for stability of the beverage can and ergonomics of the beverage can in use by a user pouring beverage from the beverage can.

The beverage can may comprise or be formed of aluminium or steel.

The beverage can may have a weight of 9 g or less, e.g. 8.97 g (before filling with a beverage). This may be for a can with a volume of 355 ml. Achieving a weight of 9 g represents a large reduction in weight compared to known cans with a volume of 355 ml (e.g. 9.55 g). This is a surprising effect of the combination of at least the aforementioned body diameter and stand diameter. The beverage can may achieve this considerably reduced weight whilst at the same time providing sufficient strength to allow handling and stacking of filled beverage cans in a conventional manner. The beverage can may capable of withstanding e.g. 6.2 bar pressure, and withstanding e.g. a 550 N top load.

The beverage can may have a weight of 10.4 g or less, e.g. 10.2 g or less. This may be for a can with a volume of 410 ml. This is considerably less than the weight of conventional 410 ml beverage cans. The beverage can may achieve this considerably reduced weight whilst at the same time providing sufficient strength to allow handling and stacking of filled beverage cans in a conventional manner. The beverage can may capable of withstanding e.g. 6.2 bar pressure, and withstanding e.g. a 550 N top load.

The beverage can may have a weight of 8.8 g or less. This may be for a can with a volume of 330 ml. This is considerably less than the weight of conventional 330 ml beverage cans. The beverage can may achieve this considerably reduced weight whilst at the same time providing sufficient strength to allow handling and stacking of filled beverage cans in a conventional manner. The beverage can may capable of withstanding e.g. 6.2 bar pressure, and withstanding e.g. a 550 N top load.

The substantial reduction of beverage can weight compared with known beverage cans provides a substantial environmental benefit. This is because less aluminium is needed for the beverage can, and in addition less fuel is needed to transport aluminium used to make the beverage can. The substantial reduction of weight also provides a substantial cost benefit because less aluminium is needed per beverage can.

The beverage can may be configured to contain a carbonated beverage. In particular the beverage can may have a minimum of 6.2 bar internal pressure resistance.

In a second aspect there is provided a method of manufacturing a beverage can, the method comprising forming a body with a body diameter Db of between 58 mm and 60 mm, and forming a base comprising a stand having a stand diameter Ds of between 44 mm and 48 mm.

Advantages arising from the method are discussed further above in connection with the first aspect.

The method of the second aspect may be a method of manufacturing the beverage can of the first aspect.

The body may be formed with a body diameter Db of between 58.5 mm and 59.5 mm, e.g. between 58.8 mm and 59.2 mm. The body may be formed with a body diameter Db of 59 mm. Beneficially, the body diameter Db may be selected to optimise the wall thickness of the body, and the weight of the base.

The base may be formed with a stand diameter Ds of between 45.2 mm and 46.2 mm to ensure sufficient internal pressure resistance performance of the beverage can. The base may be formed with a stand diameter Ds of between 45.5 mm and 45.9 mm. The base may be formed with a stand diameter Ds of 45.72 mm.

Forming the body may comprise forming a midwall section of the body. The midwall section of the body may be formed to have a wall thickness Tm of between 0.08 mm and 0.09 mm, e.g. between 0.079 mm and 0.089 mm. Preferably the midwall section of the body may be formed to have an average wall thickness Tm of 0.084 mm. The midwall section may be formed to have a generally uniform thickness. The thickness of the midwall section may be formed to have a maximum variation of ±0.005 mm across the midwall.

Forming the body may comprise forming a topwall section of the body. The topwall section of the body may be formed to have a wall thickness Tt of between 0.12 mm and 0.15 mm, e.g. between 0.130 mm and 0.146 mm The topwall section of the body may be formed to have a topwall wall thickness Tt of 0.138 mm. The topwall section may be formed to have a generally uniform thickness. Beneficially, this may provide sufficient strength at the neck and flange of the can during seaming operations to close the can. The topwall section Tt may be formed to have a length Lt of between 13 mm and 14 mm. The topwall section may be formed to have a length Lt of 13.67 mm.

The difference in thickness between the thickness Tt of the topwall section and the thickness Tm of the midwall section may be less than 0.06 mm.

Forming the body may comprise forming a transition section of the body. The transition section of the body may be formed between the midwall section and the topwall section. The transition section of the body may be formed to have a length Ltn of between 6 mm and 7 mm. The transition section of the body may be formed to have a length Ltn of 6.35 mm. The transition section of the body may have a transition wall thickness greater than the midwall thickness Tm and less than the topwall thickness Tt.

Forming the base may comprise forming a dome in the base. The dome may be formed within, e.g. radially inward of, the stand. The dome may be formed to have a dome height Hd of between 9 mm and 11 mm after spring back, e.g. between 9.6 mm and 10.3 mm after spring back. The dome may be formed to have a dome height Hd of 9.65 mm or 9.654 mm after spring back.

Forming the dome may comprise forming a first dome section defined by a first dome radius R1. The first dome section may be a central portion of the dome. Maximising the first dome radius R1 may beneficially reduce the amount of material required for the dome and thus for the can as a whole. The first dome radius R1 may be optimised to reduce material whilst maintaining sufficient pressure resistance. The first dome section may be formed to have a first dome radius R1 of between 45 mm and 52 mm.

Forming the dome may comprise forming a second dome section defined by a second dome radius R2. The second dome section may join the dome to the stand. The second dome section may be a transitional section between the dome and the stand. Reducing the second dome radius R2 may be beneficial in optimising pressure resistance of the can. The second dome section may be formed to have a second dome radius R2 of between 1 mm and 3 mm.

Forming the dome may comprise forming a third dome section defined by a third dome radius R3. The third dome section may be a transitional section between the first dome section and the second dome section. The third dome section may provide a smooth transition between the first dome section and the second dome section. The third dome section may be radially between the first dome section and the second dome section. The third dome section may be formed to have a third dome radius R3 less than the first dome radius R1 and greater than the second dome radius R2. The third dome section may be formed to have a third dome radius R3 between 16 mm and 26 mm.

The first dome radius may be larger than the second and third dome radii. The first, second and third dome sections may be concentric relative to each other. The first, second and third dome sections may be contiguous with each other.

Beneficially the combination of the first, second and third dome radii may provide the base with strength, particularly pressure resistance, whilst minimising material weight of the can. Having sufficient pressure resistance may prevent issues in filling lines and in logistics and/or consumer handling such as leaking or doming out of the can.

The first, second and third dome radii may be correlated to the stand diameter to optimise the strength of the base of the beverage can. The base may be formed to have a ratio of the first dome radius to the stand diameter R1/Ds between 1 and 1.1. The base may be formed to have a ratio of the second dome radius to the stand diameter R2/Ds between 0.04 and 0.05. The base may be formed to have ratio of the third dome radius to the stand diameter R3/Ds between 0.35 and 0.4. The base may be formed to have the ratio of the first dome radius to the stand diameter R1/Ds between 1.05 and 1.06. The base may be formed to have the ratio of the second dome radius to the stand diameter R2/Ds between 0.041 and 0.043. The base may be formed to have the ratio of the third dome radius to the stand diameter R3/Ds between 0.385 and 0.395.

The method may comprise cupping a blank before forming the body and the base. The blank may comprise or be formed of aluminium. The blank may be cut, e.g. stamped, from a sheet of aluminium. The blank may have a gauge thickness of between 0.21 mm and 0.24 mm. The blank may have a gauge thickness between 0.210 mm and 0.238 mm, e.g. between 0.224 mm and 0.234 mm. The blank may have a gauge thickness of 0.228 mm or 0.229 mm. Optimising the gauge thickness may result in a can having a pressure resistance of at least 6.2 bar, whilst reducing the gauge thickness compared to industry standard. Reducing the gauge thickness may reduce material costs, and may reduce material consumption and therefore the carbon footprint of the product. Achieving a gauge thickness between 0.224 mm and 234 mm, represents a large reduction in gauge thickness compared to known cans. This is a surprising effect of the combination of at least the aforementioned body diameter and stand diameter. The reduced gauge thickness may be achieved whilst still providing the beverage can with a desired strength (e.g. such that the beverage can may be handled and stacked in a conventional manner).

The method may further comprise necking the topwall section of the body to form a neck. The neck may be formed to have an end diameter De between 49 mm and 51 mm. The neck may have an end diameter De between 49.5 mm and 50.6 mm. The neck may have an end diameter De between 49.7 mm and 50.3 mm. The neck may have an end diameter De between 49.78 mm and 50.24 mm. Beneficially, the neck may comply with the 200 standard so that the can may be compatible with industry standard machinery, for example filling and seaming machinery. The neck may be formed to have an end diameter De of 50 mm or 50.01 mm. The 200 standard end diameter De, in combination with the preferred stand diameter Ds and preferred body diameter Db, may permit the wall thicknesses of the beverage can to be reduced as compared to known beverage cans. Because the topwall section thickens during the necking process, selecting the body diameter Db relative to the end diameter De allows for sufficient thickening of the topwall to obtain the desired flange thickness.

The neck may be formed to have a neck angle N, e.g. the angle between the neck and the body, of approximately 30°. Beneficially this may optimise the top load resistance of the can and the amount of metal required to form the neck.

The neck may be formed to have a neck height Hn of 14.45 mm.

The method may further comprise forming a flange. The flange may be formed to be generally annular. The flange may be formed to circumscribe the neck. The flange may be formed to have a flange thickness Tf of between 0.145 mm and 0.160 mm. The flange may be formed to have a flange width between 1.93 mm and 2.33 mm. The flange may be formed to have a flange width of 2.08 mm.

The method may further comprise reforming the base. Beneficially this may further strengthen the base of the can. The base may be reformed to have a reform height Hr of 2.42 mm or less. The base may be reformed to have a reform height Hr of between 2.1 mm and 2.3 mm, e.g. between 2.16 mm and 2.26 mm. The base may be reformed to have a reform height Hr of 2.21 mm. The base may be reformed to have a reform diameter Dr of between 45 mm and 46 mm, e.g. between 45.3 mm and 45.4 mm. The base may be reformed to have a reform diameter Dr of 45.33 mm. The base may be reformed to have a dome height Hdr of between 8.9 mm and 9.9 mm. The base may be reformed to have a dome height Hdr of less than 9.7 mm, e.g. less than 9.654 mm. The base may be reformed to have a dome height Hdr of between 9.1 mm and 9.6 mm. The base may be reformed to have a dome height Hdr of 9.4 mm. The reforming process may be less accurate than the forming process therefore the reform dimensions may have a greater tolerance than the initial formed dimensions.

In a third aspect there is provided a beverage can comprising a body having a body diameter Db, and a base comprising a stand having a stand diameter Ds, wherein the ratio of the body diameter Db to the stand diameter Ds is 1.3.

Beneficially, using a non-standard body diameter allows the stand diameter to be selected such that the weight of the base is reduced (compared with a conventional beverage can), whilst maintaining sufficient strength of the base. In turn, this allows for reduced wall thickness, which also reduces the weight of the beverage can. The beverage can may also be compatible with 200 standard end plates (e.g. end plates having a diameter of 50 mm+0.25 mm).

The beverage can may further comprise a neck having an end diameter De. The ratio of the body diameter Db to the end diameter De may be 1.2 to maximise the body diameter whilst ensuring the end remains compatible with the 200 standard and the beverage can has sufficient strength.

In a fourth aspect there is provided a beverage can comprising a body having a body diameter Db, and a neck having an end diameter De, wherein the ratio of the body diameter Db to the end diameter De is 1.2.

Beneficially, the ratio of the body diameter Db to the end diameter may maximise the body diameter whilst ensuring the end remains compatible with the 200 standard and the beverage can has sufficient strength.

The beverage can may further comprise a base comprising a stand having a stand diameter Ds, wherein the ratio of the body diameter Db to the stand diameter Ds is 1.3 to optimise weight and strength of the body and the base. Larger ratios may require the thickness and therefore weight of the base to be increased in order to prevent squatting of the chime region.

Optimising the ratio of the body diameter Db to the end diameter De with the ratio of the body diameter Db to the stand diameter Ds may permit the thickness of the base to be reduced whilst retaining sufficient strength, and the thickness of the body to be reduced whilst retaining sufficient internal pressure resistance. Therefore the wall thicknesses of the beverage can to be reduced as compared to known beverage cans.

In a fifth aspect there is provided a method of manufacturing a beverage can, the method comprising forming a base comprising a stand having a stand diameter Ds, and a dome having a first dome section defined by a first dome radius R1, a second dome section defined by a second dome radius R2 and a third dome section defined by a third dome radius R3, wherein the base is formed to have a ratio of the first dome radius to the stand diameter R1/Ds between 1 and 1.1, a ratio of the second dome radius to the stand diameter R2/Ds between 0.04 and 0.05, and a ratio of the third dome radius to the stand diameter R3/Ds between 0.35 and 0.4.

Beneficially, the base of a beverage can formed according to the method of the fifth aspect may have optimised strength. The dome sections may be concentric.

The base may be formed to have the ratio of the first dome radius to the stand diameter R1/Ds between 1.05 and 1.06. The base may be formed to have the ratio of the second dome radius to the stand diameter R2/Ds between 0.041 and 0.043. The base may be formed to have the ratio of the third dome radius to the stand diameter R3/Ds between 0.385 and 0.395.

Throughout the summary above and the description below, ranges are defined as being "between" two end points. These ranges are intended to be inclusive of the stated end points.

Features of different aspects of the invention may be combined together.

The above summary is intended to be merely exemplary and non-limiting. It should be understood that features defined above in accordance with any aspect of the present disclosure or below relating to any specific embodiment may be utilized, either alone or in combination with any other defined feature, in any other aspect or embodiment or to form a further aspect or embodiment.

DETAILED DESCRIPTION

Figure 1:
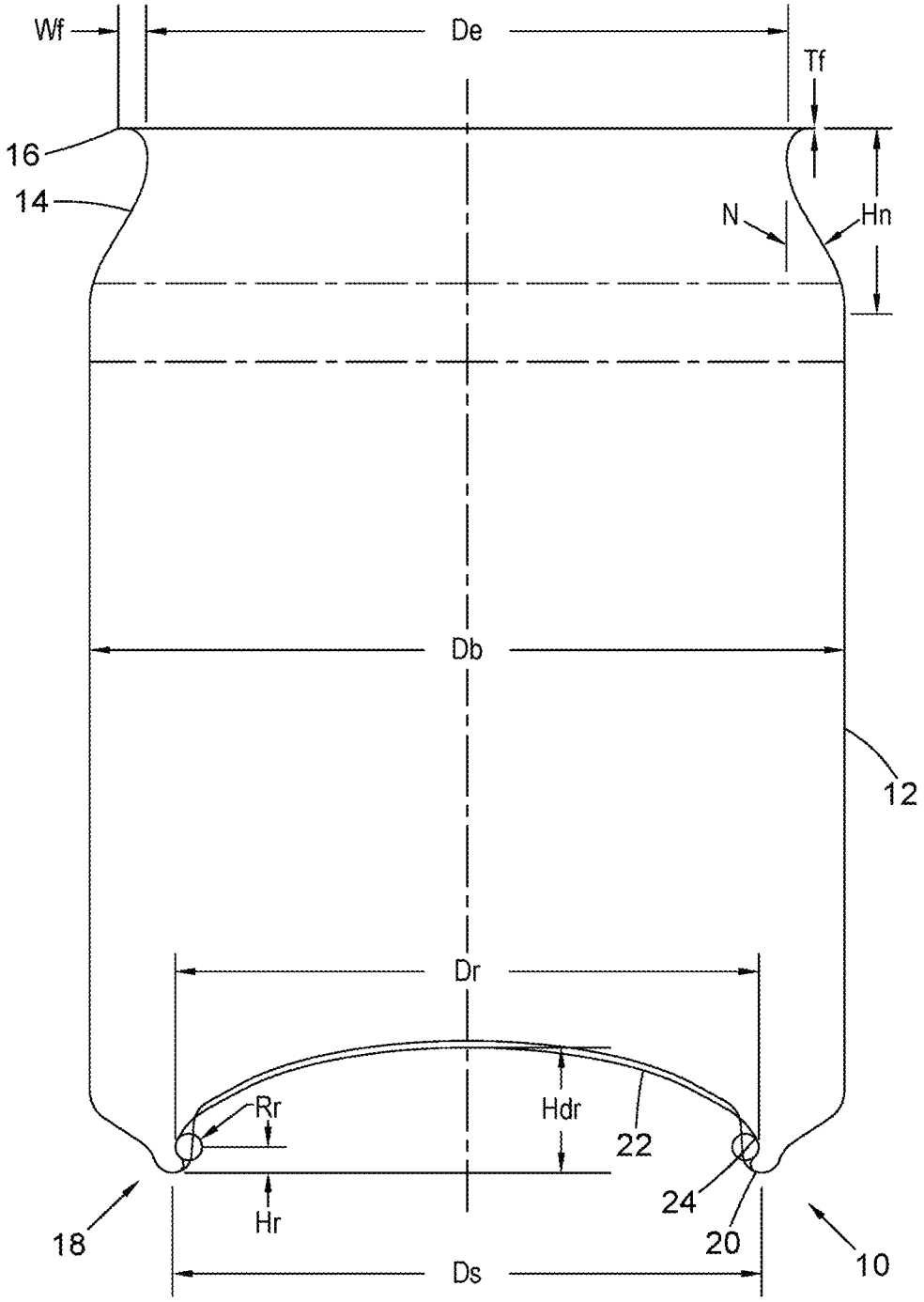
FIG. 1 shows a beverage can.

FIG. 1 shows a beverage can 10. The can 10 is of a type suitable for being filled with a carbonated beverage. The can 10 is formed of aluminium. The can has a body 12. The body 12 comprises a generally cylindrical wall. The body 12 has a diameter Db of 59 mm.

The can 10 has a neck 14. The end diameter De of the neck 14 is 50 mm. The end diameter De may have a tolerance of ±0.25 mm, e.g. +0.1 mm. Beneficially, the end diameter De allows the can 10 to be compliant with 200 standard end plates. The neck 14 is generally frustoconical.

The neck 14 and the body 12 are contiguous. The neck 14 is formed from a topwall section of the body 12. The neck 14 is formed using a plurality of necking stations, e.g. ten necking station, to form the frustoconical shape. Maximising the difference in magnitude between the body diameter Db and the end diameter De allows for the topwall section of the body 12, from which the neck is formed, to be thinner, and thereby reduces the amount of aluminium required for the can. Maximising the difference in magnitude between the body diameter Db and the end diameter De is optimised against the amount of work that the aluminium can withstand in forming the neck 14 without weakening the aluminium. Increasing the number of necking stations used to form the neck 14 also reduces the stress on the aluminium. The neck 14 is angled relative to the body 12 at a neck angle N of approximately 30°. The neck angle N is selected to optimise the top load resistance of the neck 14 and the amount of material required to form the neck 14. The neck 14 has a neck height Hn of 14.45 mm. The neck height Hn is the axial distance between the end of the neck 14 and the join of the neck 14 and the body 12, e.g. the end of the cylinder of the body 12. The can 10 has a flange 16. The flange 16 extends radially outward from the end of the neck 14. The neck 14 and the flange 16 are contiguous. The flange 16 has a flange thickness Tf between 0.145 mm and 0.160 mm. The flange 16 has a flange width Wf of 2.08 mm The transitional portion of the can 10 between the body 12 and the neck 14 has a radius, e.g. 8.89 mm. Likewise, the transitional portion of the can 10 between the neck 14 and the flange 16 has a radius, e.g. 1.4 mm. The radii between the body 12 and the neck 14, and the neck 14 and the flange 16 are smooth. Beneficially, this prevents weak spots in the can. The size of the radii is minimised in order to minimise metal consumption.

An end plate (not depicted) is fitted to the beverage can after it has been filled. The end plate may have a diameter with corresponds with the 200 standard (e.g. 50 mm±0.25 mm).

The can 10 has a base 18. The base 18 and the body 12 are contiguous. The base 18 comprises a stand 20. The stand 20 is generally annular. The stand 20 has a stand diameter Ds of 45.72 mm. The stand diameter Ds is the diameter of the annular centre plane of the stand 20 (or equivalently the diameter of the lowermost end of the stand). The difference in magnitude between the body diameter Db and the stand diameter Ds is optimised against the weight of the base 18. Increasing the stand diameter Ds generally increases the weight of the base 18 because a greater thickness of the base 18 is required to provide the base 18 with sufficient strength across its diameter. Increasing the difference in magnitude between the body diameter Db and the stand diameter Ds generally weakens the bottom against standard top load resistance requirements of 550 N.

The base further comprises a dome 22. The base further comprises a reformed portion 24. The reformed portion 24 has undergone a reformation process. The reformed portion 24 is a transitional portion between the stand 20 and the dome 22. The reformation process results in the transitional portion of the base 18 between the stand 20 and the dome 22 being pushed radially outwards. The line of the dome 22 and the stand 20 prior to reformation is also shown in FIG. 1 for reference. The reformed portion 24 has a reform radius Rr of 1.02 mm. The reform radius is the radius of the transitional portion of the base 18 between the stand 20 and the dome 22 after reformation. The reformed portion 24 has a reform diameter Dr of 45.33 mm. The reform diameter Dr is the maximum diameter of the reformed portion 24 of the base 18. The reformed portion 24 has a reform height Hr of 2.21 mm. The reform height Hr is the axial distance between the end of the stand 20 and the centre of the reform radius Rr defining the reformed portion 24. The dome 22 has a reformed dome height Hdr, e.g. a height of the dome after the reformation process has been carried out, of 9.4 mm. The height of the dome is the axial distance between the centre of the dome 22 and the end of the stand 20.

Figure 2:
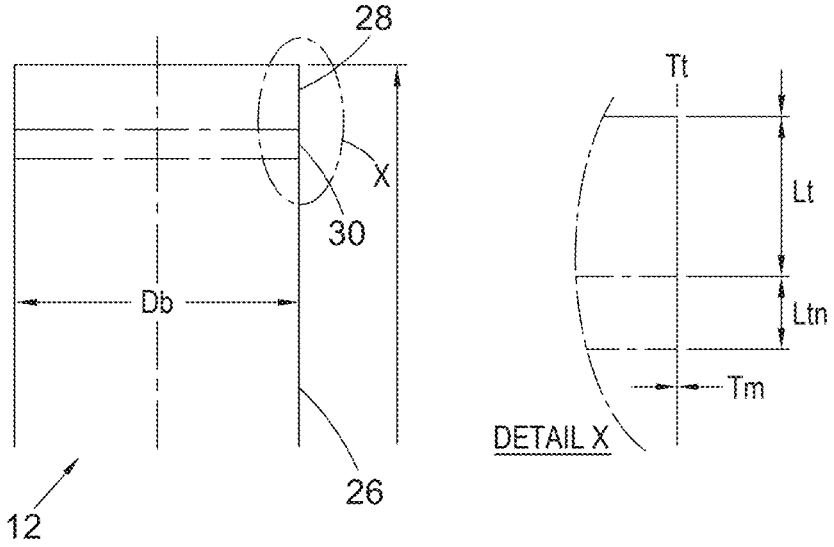
FIG. 2 shows a detailed view of wall thicknesses of the can of FIG. 1 prior to necking.

FIG. 2 shows a detailed view of the body 12 of the can 10 before a necking process to form the aforedescribed neck 14 is carried out. The body 12 comprises a midwall 26. The midwall 26 has a midwall thickness Tm of 0.084 mm. Thickness of the midwall 26 is generally uniform. The midwall 26 extends from the base 18 (not shown). The body 12 comprises a topwall 28. The topwall 28 is a section at the end of the body 12 opposite the base 18, e.g. at the nominal top of the body 12. The topwall has a topwall thickness Tt of 0.138 mm. The thickness of the topwall is generally uniform. The topwall has a topwall length Lt, e.g. the axial extent of the body having the topwall thickness Tt, of 13.67 mm. The topwall has a greater thickness than the midwall in order to ensure that the flange, once formed, has sufficient thickness for seaming. The body 12 comprises a transition section 30. The transition section 30 is between the midwall 26 and the topwall 28. The transition section 30 has a thickness greater than the midwall thickness Tm and less than the topwall thickness Tt in order to provide a smooth transition between the midwall 26 and the topwall 28. The transition section 30 has a transition length Ltn, e.g. the axial extent of the body between the midwall 26 and the topwall 28, of 6.35 mm.

Figure 3:
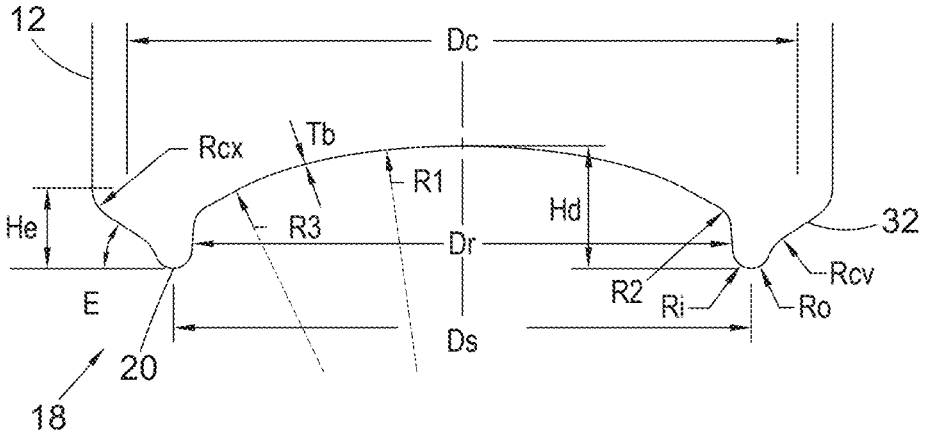
FIG. 3 shows a detailed view of the base of the can of FIG. 1 prior to reformation.

FIG. 3 shows a detailed view of the base 18 of the can 10 before the aforedescribed reformation process is carried out. A plurality of radii and angles define a transitional portion of the can between the body 12 and the base 18, herein referred to as the chime region 32. The transitional portion of the can between the body and the base may also be referred to as the coining region. Similarly, a plurality of radii define the stand 20. The radii and angles between the body 12 and the base 18, and of the stand 20, are selected to balance performance of the can 10, e.g. top load resistance, pressure resistance, etc., and weight of the can.

With continued reference to FIG. 3, the chime region 32 has a convex radius Rcx of 2.54 mm. The convex radius Rcx extends from the body 12. The chime region 32 has an chime region diameter Dc of 53.62 mm. The chime region diameter Dc is the diameter of the annular centre line of the convex radius Rcx around the can 10. The chime region 32 has an chime region height He of 6.64 mm. The chime region height He is the axial distance between the centre line of the convex radius Rcx and the end of the stand 20. The chime region 32 has a concave radius Rcv of 2.79 mm. The concave radius Rcv extends from the stand 20. The chime region 32 has an angled wall portion extending between the convex radius Rcx and the concave radius Rcv. The angled wall portion has an chime region angle E of 34°. The chime region angle E is the angle between a radial plane axially aligned with the end of the stand 20 and the angled wall.

With continued reference to FIG. 3, the stand diameter Ds is optimised to strengthen the base 18 without risking collapse of the chime region 32. The stand 20 has an outer radius Ro of 1.52 mm. The outer radius Ro extends from the concave radius Rcv of the chime region 32. The centre of the outer radius Ro falls on the centre plane of the stand 20. The stand 20 has an inner radius Ri of 1.14 mm. The inner radius Ri extends from the outer radius Ro. The centre of the inner radius Ri falls on the centre plane of the stand 20. The centre of the inner radius Ri is axially spaced apart from the centre of the outer radius Ro.

With continued reference to FIG. 3, the dome 22 has a first radius R1 in the centre of the dome 22. The first radius R1 is between 45 mm and 49 mm. The dome 22 has a second radius R2 extending from the stand 20. The second radius R2 is between 1 mm and 3 mm. The dome 22 has a third radius R3 forming a transition between the first radius R1 and the second radius R2. The third radius R3 is between 16 mm and 26 mm. The dome has a dome height Hd of 9.65 mm after spring back, caused by the metal losing pre-defined shape once tooling and load in forming is removed. This reduced dome height is the dome height Hd after spring back. The dome height Hd prior to the reformation process is larger than the dome height Hdr after the reformation process. The dome height Hd is the axial distance between the centre of the dome 22 and the end of the stand 20.

Advantageously, by selecting a neck diameter which satisfies the 200 end standard, and moving away from a standard body diameter, a lighter beverage can may be obtained which can still perform to industry standard requirements (e.g. 6.2 bar pressure resistance and 550 N top load resistance) Advantageously, the beverage can may be handled using 200 standard machinery.

This document refers to optimisation of parameters of the beverage can. In this document, optimisation may be interpreted as meaning adjusting a parameter to obtain a desired property of the beverage can (e.g. pressure resistance). It is not intended to imply that the parameter is a perfect selection. Similarly, this document refers to maximising a performance property of the beverage can via a particular can parameter. This may be interpreted as determining the parameter value either side of which the performance reduces (i.e. increasing the parameter reduces performance and reducing the parameter reduces performance). It is not intended to imply that a different parameter value cannot provide a better beverage can performance (e.g. in combination with changing other can parameter values). As an example, where this document states that the dome height may be optimised to maximise the strength of the base and minimise the weight of the base, this means that different potential values of dome height may be considered, and the dome height which provides a desired combination of strength and weight may be selected.

The beverage can may contain a carbonated beverage.

Dimensions referred to above may include some tolerance, e.g. arising from manufacturing variation. In general a can dimension referred to above may have a tolerance of ±10%. That is, the dimension may be up to 10% greater than the value stated and up to 10% less than the value stated. Other tolerances may apply.

The invention claimed is:

1. A beverage can comprising:

a body having a body diameter (Db) of 59 mm; and a base comprising a stand having a stand diameter (Ds) of between 45.2 mm and 46.2 mm;

wherein the base comprises a dome having a dome height (Hdr) of 9.4 mm, and a reformed portion having a reform height (Hr) of 2.42 mm or less and a reform diameter (Dr) of between 45 mm and 46 mm.

2. The beverage can of claim 1, wherein a neck of the beverage can has an end diameter (De) between 49.7 mm and 50.3 mm.

3. The beverage can of claim 2, wherein the neck has an end diameter (De) of 50 mm.

4. The beverage can of claim 1, wherein the base has a thickness (Tb) of 0.23 mm.

5. The beverage can of claim 1, wherein the beverage can is configured to contain a carbonated beverage.

6. The beverage can of claim 1, wherein the ratio of the body diameter (Db) to the stand diameter (Ds) is 1.3.

7. The beverage can of claim 1, wherein the beverage can further comprises a neck having an end diameter (De), and wherein the ratio of the body diameter (Db) to the end diameter (De) is 1.2.

8. A method of manufacturing a beverage can, the method comprising:

forming a body with a body diameter (Db) of 59 mm; and forming a base comprising a stand having a stand diameter (Ds) of between 45.2 mm and 46.2 mm;

wherein forming the base comprises forming a dome to have a dome height (Hd) of between 9 mm and 11 mm, and wherein forming the dome comprises forming a first dome section to have a first dome radius of between 45 mm and 52 mm, forming a second dome section to have a second dome radius of between 1 mm and 3 mm, and forming a third dome section to have a third dome radius of between 16 mm and 26 mm.

9. The method of claim 8, comprising cupping a blank before forming the body and the base, wherein the blank has a gauge thickness (Tg) of between 0.21 mm and 0.24 mm.

10. A method of manufacturing a beverage can, the method comprising:

forming a body with a body diameter (Db) of between 58 mm and 60 mm; and forming a base comprising a stand having a stand diameter (Ds) of between 44 mm and 48 mm, wherein forming the body further comprises forming a topwall section of the body to have a topwall thickness (Tt) of 0.138 mm and a topwall length (Lt) of 13.67 mm, and forming a transition section of the body to have a transition wall length (Ltn) of 6.35 mm, wherein the transition section of the body is between the midwall section and the topwall section.

11. A method of manufacturing a beverage can, the method comprising:

forming a body with a body diameter (Db) of between 58 mm and 60 mm;

forming a base comprising a stand having a stand diameter (Ds) of between 44 mm and 48 mm; and reforming the base after forming the body and the base, wherein the base is reformed to have a reform height (Hr) of 2.42 mm or less, a reform diameter (Dr) of between 45.3 mm and 45.4 mm, and a reform dome height (Hdr) of 9.4 mm.

12. A method of manufacturing a beverage can, the method comprising forming a base comprising:

a stand having a stand diameter (Ds), and a dome having a first dome section in a center of the dome defined by a first dome radius (R1), a second dome section extending from the stand defined by a second dome radius (R2) and a third dome section defined by a third dome radius (R3);

wherein the base is formed to have a ratio of the first dome radius to the stand diameter (R1/Ds) between 1 and 1.1, a ratio of the second dome radius to the stand diameter (R2/Ds) between 0.04 and 0.05, and a ratio of the third dome radius to the stand diameter (R3/Ds) between 0.35 and 0.4.

* * * * *